US005123664A

United States Patent [19]

DeMars

[11] Patent Number: 5,123,664

[45] Date of Patent: Jun. 23, 1992

[54] SNAP LOCK, STEP IN, REPLACEMENT SKATE RUNNER

[76] Inventor: Daniel G. DeMars, 9605 S. 48th St., Apt. 3034, Phoenix, Ariz. 85044

[21] Appl. No.: 650,678

[22] Filed: Feb. 4, 1991

[51] Int. Cl.[5] ..... A63C 1/30

[52] U.S. Cl. ..... 280/11.18; 403/16; 403/328

[58] Field of Search ..... 292/175, DIG. 72; 403/16, 327, 328; 280/11.17, 11.18

[56] References Cited

U.S. PATENT DOCUMENTS

| | | | |
|---|---|---|---|
| 2,221,371 | 11/1940 | De Bethune | 403/328 |
| 2,518,207 | 8/1950 | Wagner | 292/175 |
| 2,970,858 | 2/1961 | Norrenberg-Sudhaus | 292/175 X |
| 3,677,196 | 7/1972 | Schuller | 292/175 X |
| 3,947,050 | 3/1976 | Isely | 280/11.18 |

FOREIGN PATENT DOCUMENTS

| | | | |
|---|---|---|---|
| 759294 | 4/1953 | Fed. Rep. of Germany | 280/11.18 |
| 2025775 | 1/1980 | United Kingdom | 280/11.18 |

*Primary Examiner*—Andres Kashnikow
*Assistant Examiner*—Michael Mar
*Attorney, Agent, or Firm*—James F. Duffy

[57] ABSTRACT

A skate shoe to which a replacement runner may be rapidly, removably coupled. No manual manipulation of locking devices is required. A first end of the runner is pivotally coupled to the shoe's base via a slot and pin arrangement. The second end of the runner is then pivoted into snap-locking engagement with a locking mechanism in the base of the skate shoe. Finger pressure on the lock mechanism serves to unlatch the runner; and, a spring drives the runner outward from its engagement with the shoe base.

3 Claims, 1 Drawing Sheet

SNAP LOCK, STEP IN, REPLACEMENT SKATE RUNNER

BACKGROUND

1. Technical Field of the Invention

The invention relates to replaceable runners for shoe skates. The runners may be those intended for blade skating on ice or roller skating on hard surfaces. In particular, the invention relates to a replaceable runner system requiring no manual manipulation of locking devices in coupling the runners to a skate shoe.

2. Prior Background Art

The concept of a replaceable runner, removably coupled to a shoe skate is not new. However, all known apparatus for achieving this end appear to be mechanically involved, unnecessarily so. All require the actuation of locking levers or the manipulation of screw fastening devices, or the like. As a result of such necessary manual manipulations, the time required to remove a used runner and to install a new runner becomes a significant factor, especially if the person effecting the change of runners is involved in a skating sporting competition at the time the change is being made.

Ice hockey is an example of a competitive sport in which the ability to effect a rapid change of the ice skate runner blades is much to be desired. Ice conditions can adversely affect the sharpness of the runner blade edges. Further, as environmental conditions change during the course of the game, the ice surface conditions may change as well. It is thus desirable to be able to rapidly fit a player with freshly sharpened runner blades or with blades whose edges are properly contoured to most efficiently propel the player across the ice in its presently existing surface conditions.

The speed with which an ice hockey player can effect a change in skate runner blades can, conceivably, affect the outcome of the hockey game. The instant invention presents apparatus which make it possible to make a rapid change of runners, virtually by "stepping into" the new runner. The teachings here are readily, conceptually applicable to ice skate runners as well as to roller skate runners. For purposes of exposition, however, and not of limitation, the invention is disclosed in an ice skating embodiment.

SUMMARY DESCRIPTION OF THE INVENTION

In its simplest aspect, the invention may be summarized as a replacement skate runner system comprising a skate shoe having a base attached thereto. There is a skate runner having lock engaging means coupled to the base for removably coupling the skate runner to the base without manual manipulation of the lock engaging means.

Alternatively, the invention may be termed a skate runner replacement system comprising a skate shoe with a skate runner having a first end movingly coupled to the shoe. There is a second end of the runner lockingly push-coupled to the shoe. Included are means coupled to the shoe for movingly coupling the first end of the runner to the shoe, the means comprising pivotal coupling means.

The system also includes snap-locking means coupled to the shoe for snap-engaging the second end of the runner when the second end is pushed into engagement with the snap-locking means.

Finally, the invention may be delinated as a skate runner replacement system comprising a skate shoe having a base attached thereto. There is a recess in the base for matingly accepting a skate runner. To this end, there is included a snap-locking, runner engaging means coupled to the base for lockingly coupling, without manual manipulation, a first end of a skate runner to the skate shoe as the runner is pushed into the recess.

The system further comprises means for movingly coupling a second end of the skate runner into the recess as the runner is pushed into the recess and for maintaining the second end of the runner within the recess while the first end is lockingly coupled to the snap-locking engaging means. In a preferred embodiment, this means for movingly coupling the second end of the runner to the recess comprises means for pivotally coupling the second end into the recess.

Preferrably, the snap-locking, runner engaging means further comprises push-to-lock release means for disengaging the first end of the skate runner from the runner engaging means.

In more specific terms, the invention can be described as a replaceable skate runner system. The system comprises a skate shoe having a base attached to it. The base has an elongated recess with a downwardly facing opening. A transverse pin is located in a forward end of the recess as part of the means for coupling a skate runner in the recess.

There is a locking mechanism located in a rearward end of the recess. The locking mechanism includes a slide bar having a through bore with a latch tongue formed on a forward wall of the through bore and extending therein. The latch tongue has a downwardly facing inclined surface. There is a spring yieldingly biasing the slide bar to a locking position.

The system includes a runner having an upper portion adapted to be removably received within the recess. The runner also includes an open slot extending through a forward end of the upper end portion for receiving the transverse pin; and there is a tang portion extending upwardly from a rearward end of the upper portion.

An inclined edge extends between a top edge and a forward edge of the tang portion for engaging the inclined surface and for yieldingly moving the slide bar against the force of the spring when the tang portion is inserted into the through bore. A notch formed in a forward face of the tang portion receives the latch tongue when the slide bar is in the locking position.

DETAILS OF BEST MODE FOR CARRYING OUT THE INVENTION

Figure 4:
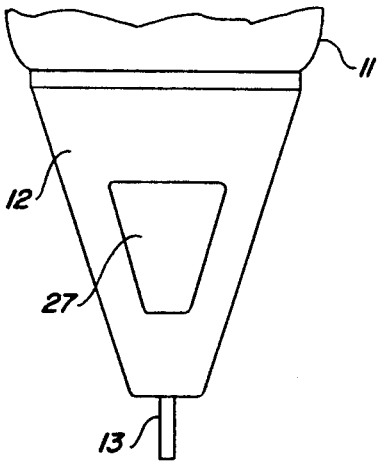
FIG. 4 is a rear elevation drawing of the lower portion of the ice skating shoe showing the replacement runner blade in place and the push-release actuator.

For purposes of promoting an understanding of the principles of the invention, reference will now be made to the embodiments illustrated in the drawings and specific language will be used to describe same. it will nevertheless be understood that no limitation of the scope of the invention is thereby intended, there being contemplated such alterations and modifications of the illustrated device, and such further applications of the principles of the invention as disclosed herein, as would normally occur to one skilled in the art to which the invention pertains.

Figure 1:
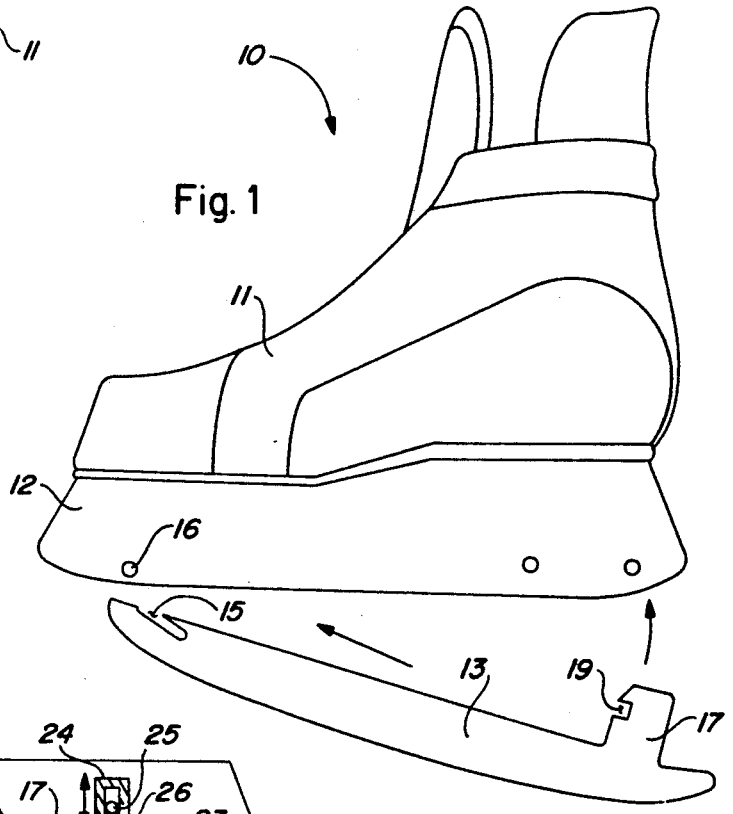
FIG. 1 illustrates an ice skating shoe having a boot to which a replacement runner blade is about to be removably coupled.

The invention 10 is shown in FIG. 1. A skate boot 11 is worn by the skater having a need or desire to rapidly change the skate runner normally attached to the boot. In the invention, boot 11 is provided with a base 12 to which a skate runner is to be removably coupled. In the embodiment of the invention disclosed herein, the runner to be removably coupled to base 12 is ice skating, runner blade 13. The front end of blade 13, the left end in the figure, is inserted into base 12 so as to engage slot 15 in blade 13 with pin 16 in base 12. The rear of blade 13 has a tang 17 which is then pivoted upwards, in rotation about pin 16, for locking engagement within base 12.

In practice, the skater will insert the slotted end of blade 13 into base 12 to engage pin 16 and then merely step down onto blade 13, in the same manner as one steps into a sandal. The skater's weight on blade 13 will cause tang 17 to move upward into locking engagement within base 12.

Figure 2:
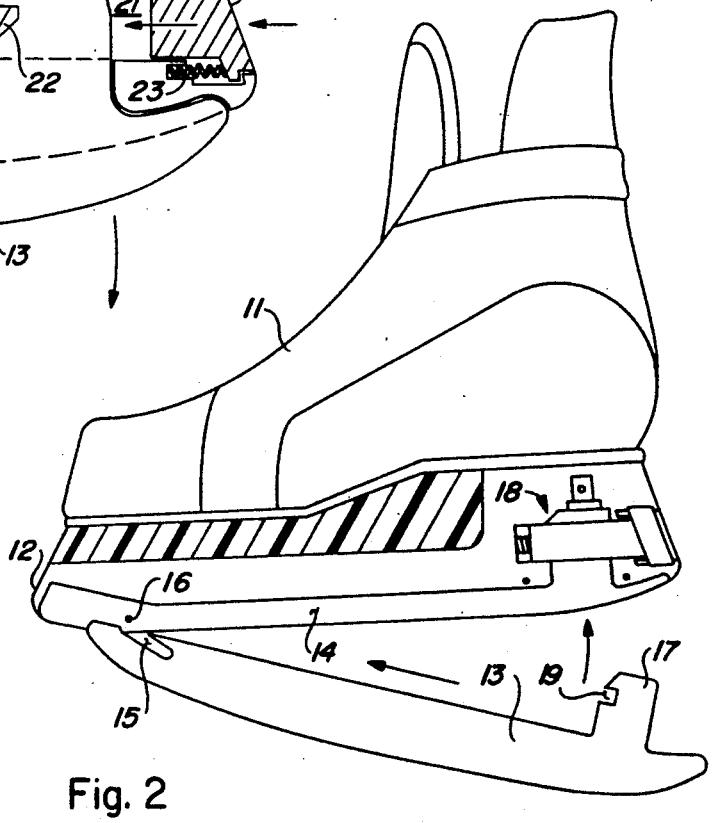
FIG. 2 shows the interior of the base of the ice skating shoe and the means whereby the replaceable runner blade is removably coupled to the shoe base.

The functional relationship of the elements involved in this action is better understood when FIG. 2 is considered. Here, the base 12 is shown in partial sectional view to allow the interior details of base 12 to be seen. Base 12 includes a recess 14 into which blade 13 will be matingly received. Pin 16 bridges across recess 14. The shape of recess 14 and the location of pin 16 allow the skater to engage pin 16 with slot 15 of blade 13.

With pin 16 and slot 15 engaged, blade 13 is moved longitudinally, in the direction indicated by the arrow paralleling blade 13, to bring the pin and slot into full engagement. Blade 13 may then be rotated upward, as indicated by the curved arrow, to cause tang 17 to become lockingly engaged with snap-locking mechanism 18 in the interior of base 12.

No manual manipulation of snap-locking mechanism 18 is required of the skater. The simple act of inserting tang 17 of blade 13 into base 12 causes tang 17 and lock mechanism 18 to lockingly engage. As noted above, locking engagement is assured when the weight of the skater is placed on blade 13.

Figure 3:
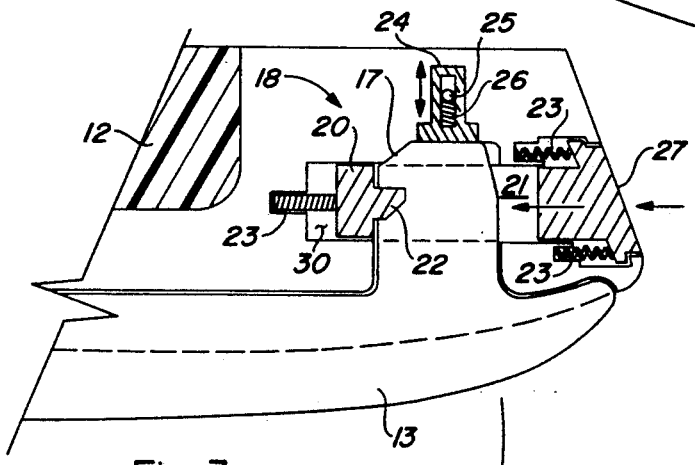
FIG. 3 is a detail of the snap lock mechanism whose actuation requires no manual manipulation and which provides a simple push-release action to decouple the replacement runner blade from the shoe.

Details of snap-lock mechanism 18 are best discerned in the partial cross sectional view of FIG. 3. Here, tang 17 of blade 13 is shown in locked engagement with lock mechanism 18. Lock mechanism 18 includes a slide bar 20 which moves slidingly within slideway 30 in base 12. Slide bar 20 has a through bore, or cavity, 21 through which a portion of tang 17 passes in coming into locking engagement with lock mechanism 18.

The passage of tang 17 through cavity 21 is impeded by the presence therein of latch tongue 22. The continuing passage of tang 17 through cavity 21 causes latch tongue 22 to move to the left of the illustration, moving slide bar 20 with it against the restraint imposed by the three springs 23 whose purpose is to maintain slide bar 20 nominally disposed to ;the right in the illustration.

As tang 17 continues to move through cavity 21, latch tongue 22 on slide bar 20 comes into coincidence with notch 19 on tang 17. When notch 19 and tongue 22 so coincide, springs 23 act in unison to drive slide bar 20 to the right of the illustration of FIG. 3. This action drives tongue 22 into latching engagement with notch 19, Tang 17 is thereby locked in its position within snap-lock mechanism 18.

While traveling to its locked disposition within cavity 21 of slide bar 20, the upper part of tang 17 moves into contact with ejection rod 24, moving rod 24 upwards and compressing spring 26 between a part of rod 24 and pin 25. This compression of spring 26 causes a downward force to be exerted on tang 17 via ejection rod 24. This arrangement provides the means for the rapid decoupling of blade 13 from base 12 of skate shoe 11.

If the skater exerts a force at the right end 27 of slide bar 20, as indicated by the arrow in FIG. 3, slide bar 20 will move to the left of the illustration. This leftward movement of slide bar 20 draws latching tongue 22 out of engagement with notch 19 in tang 17. Relieved of the restraint imposed by this engagement, tang 17 is driven downward by the force of expansion of spring 26 exerted on ejection rod 24. Tang 17 rotates downwardly about pin 16 and may be grasped by the skater who removes blade 13 from its slide-pivotal coupling with pin 16.

Finger pressure at the right end 27 of slide bar 20 is sufficient to decouple blade 13 from locking engagement within skate shoe base 12. To facilitate this decoupling, the right end 27 of slide bar 20 is exposed, for ease of contact, at the rear of base 12, below the heel of skate shoe 11, as shown in FIG. 4.

What has been disclosed is a skate shoe to which a replacement runner may be rapidly, removably coupled. No manual manipulation of locking devices is required. A first end of the runner is pivotally coupled to the shoe's base via a slot and pin arrangement. The second end of the runner is then pivoted into snap-locking engagement with a locking mechanism in the base of the skate shoe. Finger pressure on the lock mechanism serves to unlatch the runner; and, a spring drives the runner outward from its engagement with the shoe base.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such clear and concise manner that those skilled in the art may readily understand and practice the invention, that which is claimed is:

1. A replaceable skate runner system comprising:

a skate shoe having a base attached thereto, said base having an elongated recess with a downwardly facing opening;

a runner having an upper portion adapted to be removably received within said recess;

coupling means located in a forward end of said recess for captively, removably coupling a forward end of said upper portion within said forward end of said recess;

a locking mechanism located in a rearward end of said recess;

said locking mechanism including a spring loaded locking means for yieldingly engaging with a rearward end portion of said runner as said rearward end portion of said runner is inserted into said rearward end of said recess, and for maintaining said rearward end portion of said runner therein by spring loading exerted thereon; and, said spring loaded locking means comprises a slide bar having a through bore for receiving said rearward end portion, said through bore having a latch tongue formed on a forward wall of said through bore and extending therein, said latch tongue having a downwardly facing inclined surface; and a spring yieldingly biasing said slide bar to a locking position.

2. The replacable skate runner system of claim 1 wherein said runner includes:

a tang portion extending upwardly from a rearward end of said upper portion, an inclined edge extending between a top edge and a forward edge of said tang portion for engaging said inclined surface and for moving said slide bar against the force of said spring when said tang portion is inserted into said through bore, and a notch formed in a forward face of said tang portion for receiving said latch tongue when said slide bar is in said locking position.

3. A replaceable skate runner system comprising:

a skate shoe having a base attached thereto, said base having an elongated recess with a downwardly facing opening, a transverse pin located in a forward end of said recess, and a locking mechanism located in a rearward end of said recess, said locking mechanism including a slide bar having a through bore with a latch tongue formed on a forward wall of said through bore and extending therein, said latch tongue having a downwardly facing inclined surface, and a spring for biasing said slide bar to a locking position; and a runner having an upper portion adapted to be removably received within said recess, said runner including an open slot extending through a forward end of said upper portion for receiving said transverse pin, and a tang portion extending upwardly from a rearward end of said upper portion, an inclined edge extending between a top edge and a forward edge of said tang portion for engaging said inclined surface and for moving said slide bar against the force of said spring when said tang portion is inserted into said through bore, and a notch formed in a forward face of said tang portion for receiving said latch tongue when said slide bar is in said locking position.

* * * * *